US007166956B2

(12) United States Patent
Ito et al.

(10) Patent No.: US 7,166,956 B2
(45) Date of Patent: Jan. 23, 2007

(54) METAL BACK-CARRYING FLUORESCENT SURFACE, METAL BACK FORMING TRANSFER FILM AND IMAGE DISPLAY UNIT

(75) Inventors: Takeo Ito, Kumagaya (JP); Hajime Tanaka, Fujioka (JP); Tomoko Nakazawa, Maebashi (JP); Masaaki Inamura, Fukaya (JP); Taichiro Nakayama, Kyoto (JP); Takaaki Shinohara, Kyoto (JP); Yoichiro Nakayama, Kyoto (JP); Kazuo Sakai, Kawanishi (JP)

(73) Assignees: Kabushiki Kaisha Toshiba, Tokyo (JP); Nikka Techno, Inc., Kyoto (JP); Fuji Pigment Co., Ltd., Kawanishi (JP)

( * ) Notice: Subject to any disclaimer, the term of this patent is extended or adjusted under 35 U.S.C. 154(b) by 37 days.

(21) Appl. No.: 10/483,556

(22) PCT Filed: Jul. 12, 2002

(86) PCT No.: PCT/JP02/07084

§ 371 (c)(1),
(2), (4) Date: Jan. 13, 2004

(87) PCT Pub. No.: WO03/007324

PCT Pub. Date: Jan. 23, 2003

(65) Prior Publication Data

US 2004/0178718 A1 Sep. 16, 2004

(30) Foreign Application Priority Data

Jul. 13, 2001 (JP) ..... 2001-214338

(51) Int. Cl.
*H01J 29/10* (2006.01)

(52) U.S. Cl. ..... 313/461; 313/496

(58) Field of Classification Search ..... 313/461, 313/496

See application file for complete search history.

(56) References Cited

U.S. PATENT DOCUMENTS 5,141,461 A 8/1992 Nishimura et al.

(Continued)

FOREIGN PATENT DOCUMENTS

JP 63-102139 5/1988

(Continued)

OTHER PUBLICATIONS

U.S. Appl. No. 10/580,158, filed May 19, 2006, Inamura et al.

(Continued)

*Primary Examiner*—Nimeshkumar D. Patel
*Assistant Examiner*—Anthony Perry
(74) *Attorney, Agent, or Firm*—Oblon, Spivak, McClelland, Maier & Neustadt, P.C.

(57) ABSTRACT

A metal back-attached phosphor screen comprises a metal back layer that has a high-reflectance, high-resistance layer consisting of an In-, Sn- or Bi-oxide layer. The metal back layer of the metal back-attached phosphor screen may have a laminate structure including a high-reflectance layer formed on a phosphor layer side and a high-resistance layer formed on that layer. The high-reflectance layer may be formed of Al, In, Sn or Bi. The high-resistance layer may be formed of an Al-, In-, Sn-, Bi- or Si-oxide or nitride. A high-brightness metal back-attached phosphor screen is provided that prevents the destruction or the deterioration of an electron emission element and a phosphor screen by discharging.

9 Claims, 3 Drawing Sheets

U.S. PATENT DOCUMENTS

| | | | | |
|---|---|---|---|---|
| 6,048,652 | A * | 4/2000 | Nguyen et al. | 430/5 |
| 6,372,608 | B1 * | 4/2002 | Shimoda et al. | 438/455 |
| 6,812,636 | B1 * | 11/2004 | Porter et al. | 313/496 |
| 2004/0150324 | A1 | 8/2004 | Ito et al. | |
| 2004/0170862 | A1 | 9/2004 | Ito et al. | |

FOREIGN PATENT DOCUMENTS

| | | |
|---|---|---|
| JP | 64-30134 | 2/1989 |
| JP | 3-49131 | 3/1991 |
| JP | 4-51423 | 2/1992 |
| JP | 5-190084 | 7/1993 |
| JP | 8-21320 | 3/1996 |
| JP | 9-283025 | 10/1997 |
| JP | 10-149108 | 6/1998 |
| JP | 10-326583 | 12/1998 |
| JP | 10-340693 | 12/1998 |
| JP | 2000-82416 | 3/2000 |
| JP | 2000-251804 | 9/2000 |
| JP | 2001-185050 | 7/2001 |
| WO | 01/57905 | 8/2001 |

OTHER PUBLICATIONS

U.S. Appl. No. 10/551,758, filed Oct. 3, 2005, Yoshii et al.

* cited by examiner

METAL BACK-CARRYING FLUORESCENT SURFACE, METAL BACK FORMING TRANSFER FILM AND IMAGE DISPLAY UNIT

TECHNICAL FIELD

The present invention relates to a metal back-attached phosphor screen, a transfer film for forming a metal back and an image display unit having the metal back-attached phosphor screen.

BACKGROUND ART

For a conventional image display unit such as a cathode-ray tube (CRT) or a field emission display (FED), a metal back-attached phosphor screen, which has a metal film formed on the inner surface (surface opposite to the face plate) of a phosphor layer, has been used extensively.

Such a metal film is called a metal back layer and aimed to enhance brightness by reflecting light, which is in light emitted from the phosphor material by electrons emitted from an electronic source and advances toward the electronic source, to the face plate side and to play a role as an anode electrode by giving the phosphor layer with conductivity. It also has a function to prevent the phosphor layer from being damaged by ions generated when gas remaining in a vacuum envelope is ionized.

However, the FED had a disadvantage that an electric discharge (vacuum arc discharge) was caused easily when an image is formed for a long period because a gap (space) between a face plate having a phosphor screen and a rear plate having an electron emission element was narrow to approximately one to several millimeters and a high voltage of about 10 kV was applied to the very narrow gap to form a high electric field.

And, when such an abnormal electric discharge occurred, a large discharge current of several to several hundred amperes flowed instantaneously, so that there was a possibility that the electron emission elements of a cathode section or the phosphor layer of an anode section might be destructed or damaged.

The present invention has been made to remedy the above-mentioned disadvantages and provides an image display unit which has high brightness and a high withstand voltage characteristic and can provide high quality display by suppressing a peak value of discharge current even if an electric discharge occurs, so to prevent the electron emission element or the phosphor screen from being destructed or deteriorated.

SUMMARY OF THE INVENTION

A first embodiment of the present invention is a metal back-attached phosphor screen, comprising a phosphor layer formed on the inner surface of a face plate and a metal back layer formed on the phosphor layer, wherein the metal back layer has a high light reflectance and high electric resistivity.

In the metal back-attached phosphor screen of the first embodiment, the metal back layer can be comprised of oxide of at least one type of metal selected from In, Sn and Bi. And, the metal back layer can further have a baking-resistant layer which is comprised of Si-oxide.

A second embodiment of the present invention is a metal back-attached phosphor screen, comprising a phosphor layer formed on the inner surface of a face plate and a metal back layer formed on the phosphor layer, wherein the metal back layer has a high-reflectance layer which has a high light reflectance and a high-resistance layer which has high electric resistivity, the high-reflectance layer being formed on the phosphor layer side and the high-resistance layer being formed on the top layer of the high-reflectance layer.

In the metal back-attached phosphor screen of the second embodiment, the high-reflectance layer can be comprised of at least one type of metal selected from Al, In, Sn and Bi. The high-resistance layer can be comprised of oxide or nitride of at least one type of element selected from Al, In, Sn, Bi and Si. Besides, in the metal back-attached phosphor screen of the second embodiment, the metal back layer can further have a baking resistant layer which is comprised of Si-oxide. The baking-resistant layer can be formed between the high-reflectance layer and the high-resistance layer or on the top and the bottom of these layers to remedy the degradation of a resistance value and a reflectance.

A third embodiment of the present invention is a transfer film for forming a metal back, comprising a base film, a parting agent layer which is formed on the base film, a high-reflectance, high-resistance layer which is formed over the parting agent layer and has a high light reflectance and high electric resistivity, and an adhesive agent layer which is formed on the high-reflectance, high-resistance layer.

In the transfer film for forming a metal back of the third embodiment, the high-reflectance, high-resistance layer can be comprised of oxide of at least one type of metal selected from In, Sn and Bi. And, it can further heve a protective film which is formed on the parting agent layer.

A fourth embodiment of the present invention is a transfer film for forming a metal back, comprising, a base film, a parting agent layer which is formed on the base film; a high-resistance layer which is formed over the parting agent layer and has high electric resistivity, a high-reflectance layer which is formed on the high-resistance layer and has a high light reflectance, and an adhesive agent layer which is formed on the high-reflectance layer.

In transfer film for forming a metal back of the fourth embodiment, the high-resistance layer can be comprised of oxide or nitride of at least one type of element selected from Al, In, Sn, Bi and Si. The high-reflectance layer can be comprised of at least one type of metal selected from Al, In, Sn and Bi. Besides, the transfer film for forming a metal back of the fourth embodiment can further have a protective film which is formed on the parting agent layer.

A fifth embodiment of the present invention is an image display unit comprising a face plate, an electron source which is disposed opposite to the face plate, and a phosphor screen which is formed on the face plate and emits light by electrons emitted from the electron source, wherein the phosphor screen is the metal back-attached phosphor screen of the first embodiment.

A sixth embodiment of the present invention is an image display unit comprising a face plate, an electron source which is disposed opposite to the face plate, and a phosphor screen which is formed on the face plate and emits light by electrons emitted from the electron source, wherein the phosphor screen is the metal back-attached phosphor screen of the second embodiment.

The metal back-attached phosphor screen according to the first embodiment of the invention has on the phosphor layer the metal back layer, which is comprised of metal oxide having a high light reflectance and high electric resistivity. And, the metal back-attached phosphor screen of the second embodiment has a laminated structure in that the metal back layer has a metal layer with a high reflectance disposed on phosphor layer side and a metal oxide layer having high electric resistivity disposed on the rear plate side.

Therefore, in the image display unit having such a metal back-attached phosphor screen on the inner surface of the face plate, an electric discharge between the metal back layer of the phosphor screen and the rear plate is suppressed, and the peak value of discharge current is suppressed to a low level even if the electric discharge occurs. Thus, the maximum value of energy emitted at the electric discharge is reduced, and the electron emission element or the phosphor screen is prevented from being destructed, damaged or deteriorated. And, the metal back layer produces a sufficiently high reflex effect, so that a high-brightness phosphor screen can be obtained.

Meanwhile, when the metal back layer has the laminated structure of the second embodiment, there is an effect of the base layer, so that an apparent resistance value may not become high even if a thin high-resistance layer is overlaid on it. But, it is recognized that even such a configuration provides a remarkable effect of suppressing the occurrence of electric discharge and makes improvement.

Besides, the phosphor screen having the layer made of Si-oxide as the top layer and/or the bottom layer and/or the intermediate layer of the individual layers configuring the metal back layer has the improved baking-resistant characteristic to prevent the reflectance from being lowered by baking. In other words, the layer made of the metal oxide is porous, and direct vapor deposition of metal thereon does not provide a layer having a good light reflex effect, but, when the Si-oxide layer is formed on the bottom layer, there is produced a leveling (flattening) effect. And, this leveling effect provides an effect of preventing that the metal layer has a lowered reflectance. Thus, the above-described both effects can improve the reflectance and prevent the resistance value from being deteriorated by heat.

Especially, when the metal back layer is to be formed on the phosphor screen by vapor deposition, a film of an organic resin is formed on the base to level the phosphor screen, Al or the like is vapor-deposited, and the organic resin is baked out to obtain the metal back layer having a high reflectance. But, its reflectance tends to be lowered by baking. The Si-oxide layer disposed as a part of the metal back layer suppresses the high-reflectance layer or the high-resistance layer formed of another metal or metal oxide from being scattered in the baking process, and the reflectance is suppressed from being degraded. The Si-oxide layer itself is translucent, so that the high-brightness phosphor screen can be obtained without disturbing the reflex effect of the high-reflectance layer which is made of another metal.

BEST MODE FOR CARRYING OUT THE INVENTION

Preferred embodiments of the present invention will be described. It is to be understood that the present invention is not limited to the following embodiments.

Figure 1:
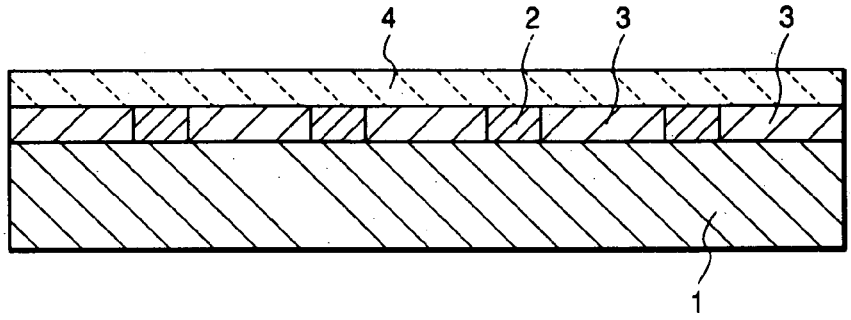
FIG. 1 is a sectional diagram showing a first embodiment of the metal back-attached phosphor screen according to the present invention.
Figure 2:
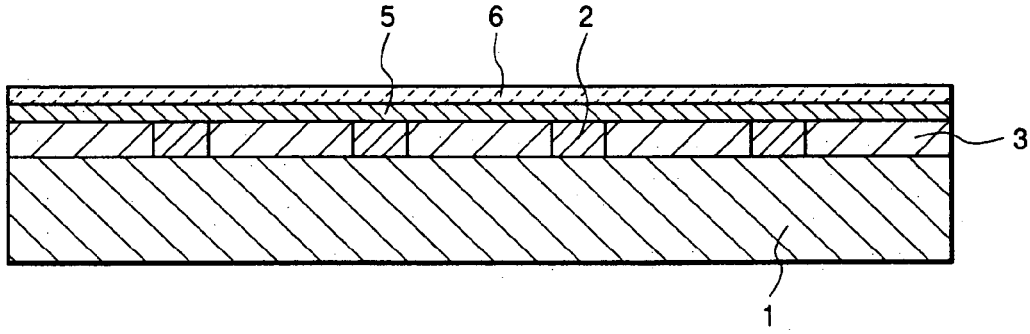
FIG. 2 is a sectional diagram showing a second embodiment of the metal back-attached phosphor screen according to the present invention.
Figure 3:
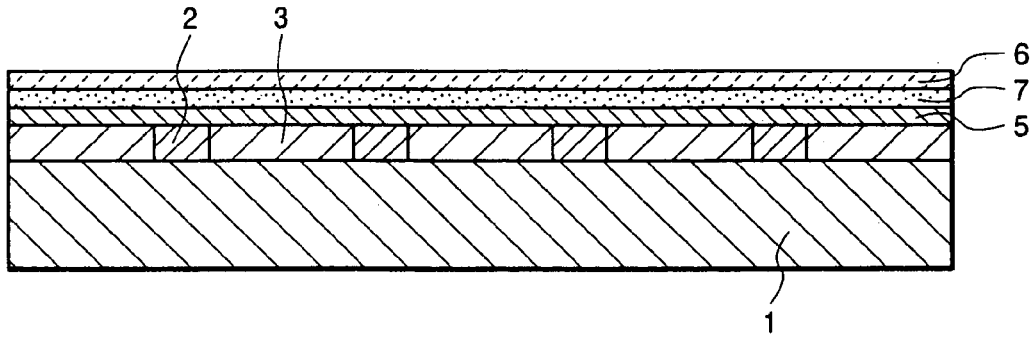
FIG. 3 is a sectional diagram showing a third embodiment of the metal back-attached phosphor screen according to the present invention.

FIG. 1 to FIG. 3 each are sectional diagrams schematically showing the first to third embodiments of the metal back-attached phosphor screens according to the present invention.

In such metal back-attached phosphor screens, a phosphor screen is disposed on the inner surface of a face plate 1 such as a glass substrate. The phosphor screen comprises a light absorption layer (BM) 2 having a prescribed pattern (e.g., a dot or stripe form) formed on the face plate 1 and a phosphor layer 3 of three colors of red (R), green (G) and blue (B) arranged in a prescribed pattern in the light absorption layer (BM) 2.

And, according to the first embodiment, a high-reflectance, high-resistance layer 4, which has a high light reflectance and high electric resistivity, is formed as a metal back layer on the phosphor screen as shown in FIG. 1.

The high-reflectance, high-resistance layer 4 can be comprised of oxide of at least one type of metal selected from In, Sn and Bi.

According to the second embodiment, the metal back layer is configured by laminating a reflectance layer 5 having a high light reflectance and a high-resistance layer 6 having high electric resistivity, and the high-reflectance layer 5 is disposed on the phosphor layer 3, and the high-resistance layer 6 is disposed on the high-reflectance layer 5 as shown in FIG. 2. According to the second embodiment in which the metal back layer has a laminated structure, the cost is higher than in the first embodiment, but better characteristics can be obtained.

As the high-reflectance layer 5, a layer of at least one metal selected from Al, In, Sn and Bi can be used. As the high-resistance layer 6, an oxide layer of at least one of element selected from Al, In, Sn, Bi and Si can be used. Besides, it can be a layer of nitride such as AlN.

In the second embodiment, the two layers of the high-reflectance layer 5 and the high-resistance layer 6 are laminated to form the metal back layer, but both the layers may have their compositions mixed each other on the interface because they are very thin. Therefore, there is obtained an effect of mutually affecting these layers characteristically. According to a method of measuring with an electrode pushed, the resistance value indicates a non-high value in an area where the film is particularly thin because it is affected by the lower metal film, but a noticeable electric discharge suppressing effect was confirmed by an actual withstand voltage test. And, the peak value of discharge current could be suppressed to some extent.

Besides, in the third embodiment, the metal back layer has a three-layered structure in that a Si-oxide layer 7 is held between the high-reflectance layer 5 and the high-resistance layer 6 which are configured in the same way as in the second embodiment as shown in FIG. 3. And, such a metal back layer is formed to have the high-reflectance layer 5 disposed on the side of the phosphor layer 3.

Here, the Si-oxide layer 7 can be formed on at least one position selected from the bottom of the high-reflectance layer 5, the top of the high-resistance layer 6 and the interface between the high-reflectance layer 5 and the high-resistance layer 6. In the first embodiment, the Si-oxide layer can be formed on one of the top side and the bottom side of the high-reflectance, high-resistance layer 4.

The above-described oxides are not required to be compounds completely oxidized stoichiometrically but may be in an incompletely oxidized state. In other words, the individual oxides have a composition which can be indicated as $MeO_x$.

The value of oxidation degree x in $SiO_x$ is preferably in a range of 1.0 to 2.0. And, the value of oxidation degree x in the formula $In_2O_x$ is desirably in a rage of 1.0 to 3.0.

In the first to third embodiments, the metal back layer has preferably a total thickness of 10 to 200 nm, and more preferably falls in a range of 30 to 120 nm. When the metal back layer has a thickness beyond the above-described range, the metal back layer absorbs an electron beam, so that brightness lowers considerably. Conversely, when the metal back layer is excessively thin, the light reflex effect lowers, and the brightness is deteriorated considerably.

To form the metal back-attached phosphor screens of the first to third embodiments, the light absorption layer 2, consisting of a black pigment and having a prescribed pattern, is first formed on the inner surface of the face plate 1 by photolithography or the like. A ZnS-based, $Y_2O_3$-based or $Y_2O_2S$-based phosphor liquid is applied by a slurry method or the like and dried, and patterning is conducted by photolithography to form the phosphor layer 3 having three colors of red (R), green (G) and blue (B). The phosphor layer 3 having the respective colors can also be formed by a spray method or a printing method. When the spray method or the printing method is used, the patterning by the photolithography can also be used as required.

Then, the metal back layer is formed on the phosphor screen which is formed as described above. To form the metal back layer, a thin film of an organic resin such as nitrocellulose is formed on the phosphor screen by, for example, a spin coat method, the above-described high-reflectance, high-resistance layer 4 is formed on it by vapor deposition, or the high-reflectance layer 5 and the high-resistance layer 6 are sequentially formed on it by vapor deposition. Then, calcination (baking) is conducted to remove organic material.

A transfer film can also be used to form the metal back layer. When the transfer film is used, the metal back layer can be formed more efficiently with improved productivity.

The transfer film is configured to have the high-reflectance, high-resistance layer consisting of oxide of In, Sn or Bi, formed on the base film with the parting agent layer (and also a protective film, if necessary) intervening therebetween and an adhesive agent layer formed on it. It is also configured to have a high-reflectance layer of Al, In, Sn or Bi and a high-resistance layer of oxide of Al, In, Sn, Bi or Si laminated on the base film with the parting agent layer (also a protective film, if necessary) intervening. The high-reflectance layer is positioned on the top, and the adhesive agent layer is additionally formed on it.

The above-configured transfer film can have the Si-oxide layer formed on the top side or the bottom side of the high-reflectance, high-resistance layer. And, the Si-oxide layer can be formed on at least one position of the top of the high-reflectance layer, the bottom of the high-resistance layer and the intermediate between the high-resistance layer and the high-reflectance layer.

To form the transfer film, a film consisting of oxide of at least one type of metal selected from Al, In, Sn and Bi can be formed by the following method.

Specifically, metal of Al, In, Sn or Bi is vapor-deposited in a high vacuum of $6.7\times10^{-3}$ to $4.0\times10^{-2}$ Pa ($5\times10^{-5}$ to $3\times10^{-4}$ Torr) while introducing oxygen at a rate of 0.5 to 4 liters/minute under generation of a plasma discharge. The oxygen introduced in this way is subjected to activation-ionization, and a vapor-deposited substance is continuously oxidized to form an oxide layer of such a metal. Surface resistivity of the metal oxide layer being formed can be controlled by adjusting an amount of oxygen being introduced. As the vapor deposition method, a high-frequency induction heating vapor deposition method, an electric resistance heating vapor deposition method, an electron beam heating vapor deposition method, a sputtering vapor deposition method or an ion plating vapor deposition method can be used.

In the formation of the transfer film, a method such as sputtering can be used to form a layer comprising Si-oxide or AlN.

Then, the transfer film is disposed to have the adhesive agent layer come into contact with the phosphor layer, and a pressing treatment is conducted. The pressing method includes a stamp method, a roller method and the like. Thus, the transfer film is pressed to adhere the metal and metal oxide layers, and the base film is peeled to transfer the metal and metal oxide layers to the phosphor screen so to obtain the metal back-attached phosphor screens shown in the first to third embodiments.

Figure 4:
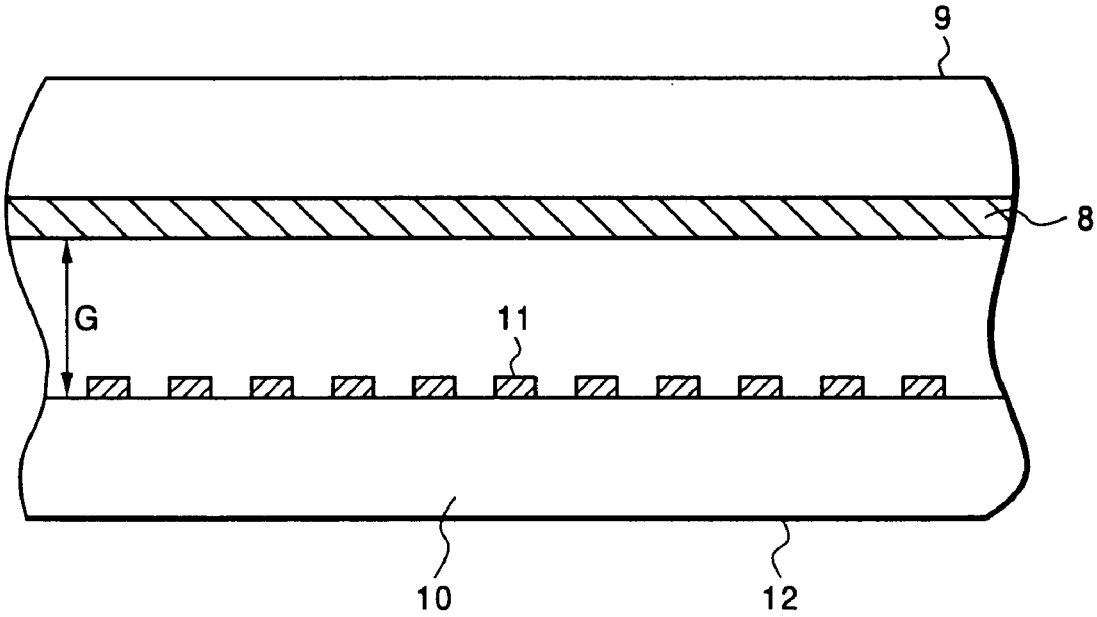
FIG. 4 is a diagram schematically showing a configuration of the FED provided with the metal back-attached phosphor screen according to the present invention.
Figure 5:
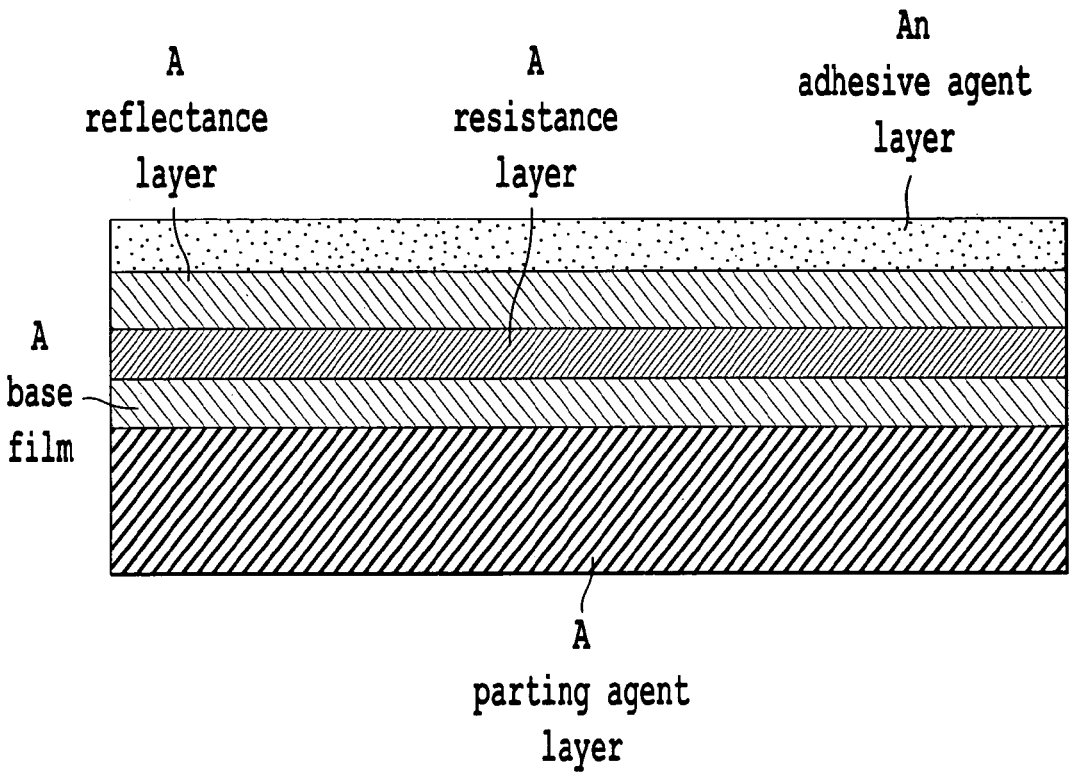
FIG. 5 is a cross-section schematically showing a structure of a transfer film for forming a metal back.

The FED having the above metal back-attached phosphor screen as the anode electrode is shown in FIG. 4. This FED is configured in that a face plate 9 having a metal back-attached phosphor screen 8 and a rear plate 12 having an electron emission element 11 arranged in matrix on a substrate 10 are disposed opposite to each other with a small gap (space) G of one to several millimeters between them, and a high voltage of 5 to 15 kV is applied to the very small gap G between the face plate 9 and the rear plate 12.

The gap between the face plate 9 and the rear plate 12 is so small that an electric discharge (dielectric breakdown) occurs readily, but the FEDs having the metal back-attached phosphor screens 8 of the first to third embodiments suppress the generation of an abnormal electric discharge, suppress the peak value of discharge current when the electric discharge is generated and prevents an instantaneous concentration of energy. Because the maximum value of electric discharge energy is reduced, the electron emission element 11 and the phosphor screen are prevented from being destructed, damaged or deteriorated. And, the metal back layer is secured to have sufficient light reflectivity and has high brightness.

Then, specific examples applying the present invention to the image display unit will be described.

EXAMPLE 1

First, a transfer film was produced by the following procedure.

A parting agent layer mainly consisting of silicone resin and having a thickness of 0.5 μm was formed on a base film of polyester resin having a thickness of 20 μm, and a protective film mainly consisting of melamine resin having a thickness of 1 μm was formed thereon.

Then, a two-layered film was formed on the protective film by vapor deposition. A degree of vacuum was increased to $1.33\times10^{-3}$ Pa ($1\times10^{-5}$ Torr), aluminum was vapor-deposited while introducing a very small quantity of oxygen (1 liter/$m^2$) under generation of a plasma discharge to form an aluminum oxide layer (thickness of 20 nm) on the protective film. Then, aluminum was vapor-deposited without the presence of oxygen to form an aluminum layer (thickness of 60 nm) on the aluminum oxide layer. An adhesive agent layer mainly consisting of vinyl acetate resin or the like having a thickness of 12 μm was additionally formed thereon to complete a transfer film.

Then, a light absorption layer (light shield layer) consisting of a black pigment and in a stripe form was formed on one side of a face plate for the FED by a screen printing method. A phosphor layer having three colors of red (R), green (G) and blue (B) was formed in a stripe form between the stripes of the light shield section so to adjacent to each other by the screen printing method.

Then, the transfer film was disposed to have an adhesive agent layer contacted to the phosphor layer, they were bonded under pressure by a rubber roller, and the base film was peeled to transfer the two-layered film having the aluminum layer and the aluminum oxide layer laminated onto the phosphor layer. Then, a heating treatment (baking) was conducted at 450° C. for one hour to complete a metal back-attached phosphor screen.

The metal back-attached phosphor screen obtained as described above had a reflectance of 80% as compared with a conventional phosphor screen having an aluminum film as the metal back layer. The side opposite to the phosphor layer of the metal back layer was a brown color aluminum oxide layer with a light reflectance of only 30%.

Then, an electron generation source having many surface conduction type electron emission elements formed in a matrix form on a substrate was fixed onto a rear plate. This rear plate and the face plate having the metal back-attached phosphor screen described above were disposed opposite to each other with a gap of about one millimeter between them and sealed with flit glass through a support frame. Then, necessary treatments such as evacuation, sealing and the like were conducted to complete a 10-inch color FED. The FED obtained as a result was driven at an acceleration voltage of 5 kV, a current density of 20 $\mu A/cm^2$ and an overall raster signal, and center brightness was measured. High relative brightness of 80% was shown when it was assumed that the conventional FED having the aluminum film as the metal back layer was 100%. And, the maximum value of withstand voltage was improved to 8 kV. Besides, the peak current value at the discharge was lowered substantially to 20 A as compared with the conventional FED value (100 A and 10 kV), and the phosphor layer and the electron source could be prevented from being damaged at the occurrence of electric discharge.

EXAMPLE 2

A transfer film was produced in the same way as in Example 1 except that a transfer film for metal back forming was formed as follows. Specifically, a Si-oxide layer (thickness of 20 nm) was formed on a protective film, and aluminum was vapor-deposited without the presence of oxygen to form an aluminum layer (thickness of 40 nm) on a Si-oxide layer.

Then, the transfer film was used to transfer in the same way as in Example 1, and baking was made to complete a metal back-attached phosphor screen. The metal back layer's reflectance was the same high value of 100% on the phosphor layer side as the one having a conventional aluminum film.

Then, the obtained metal back-attached phosphor screen was used to complete a 10-inch color FED in the same way as in Example 1. This FED was driven at an acceleration voltage of 10 kV, a current density of 20 $\mu A/cm^2$ and an overall raster signal, and center brightness was measured to find that it had the same high brightness as in Example 1. The withstand voltage characteristic was improved substantially to 12 kV, and the discharge current improving effect was also confirmed.

EXAMPLE 3

A transfer film was produced in the same way as in Example 1 except that a metal back forming transfer film was formed as follows. Specifically, an Al-oxide layer (thickness of 20 nm), a Si-oxide layer (thickness of 20 nm) and an aluminum layer (thickness of 60 nm) were laminated in this order on a protective film by vapor deposition in the same way as in Example 1.

Then, this transfer film was used to transfer in the same way as in Example 1, and baking was conducted to complete a metal back-attached phosphor screen. By a base smoothing effect of the Si-oxide, the reflectance of the aluminum layer was improved to obtain relative brightness of substantially 100%. Meanwhile, for reductions of the withstand voltage and discharge current, the same conspicuous effect as in Example 1 was obtained.

EXAMPLE 4

Instead of an aluminum oxide layer, an In-oxide layer (thickness of 80 nm) was formed on the protective film of the transfer film in the same way as in Example 1. In this example, the In-oxide layer was formed as a single layer film and transferred onto a phosphor layer. And, the obtained metal back-attached phosphor screen was used to complete a 10-inch color FED in the same way as in Example 1.

This FED had relative brightness of 50%, and the metal back layer had insufficient reflectance, but a resistance value was on the order of the 5th power of 10, and a discharge current reduction effect was maximum of Examples.

The measured results of the reflectance of the metal back-attached phosphor screens, brightness and withstand voltage characteristic of FED and discharge current obtained in the above-described Examples 1 to 4 are shown in Table 1 together with the measured results of the phosphor screen (Comparative Example) having the conventional aluminum metal back.

TABLE 1

| | Examples | | | | |
|---|---|---|---|---|---|
| | 1 | 2 | 3 | 4 | CE |
| [Metal back structure] | | | | | |
| Phosphor layer side | A1 (60 nm) | A1 (40 nm) | A1(60 nm) | Single layer | Single layer |
| Intermediate | — | — | $SiO_2$(20 nm) | $In_2O_x$ | A1 |
| Rear panel side | $Al_2O_x$ (20 nm) | $SiO_2$ (20 nm) | $Al_2O_x$ (20 nm) | (80 nm) | (80 nm) |
| [Evaluation of semi-finished goods] | | | | | |
| Reflectance: | | | | | |
| before baking | 90 | 100 | 100 | 70 | 100(STD) |
| after baking | 80 | 100 | 100 | 50 | 100(STD) |
| [Evaluation of FED] | | | | | |
| Relative brightness(%) | 80 | 100 | 100 | 50 | 100(STD) |
| Max. withstand voltage(kV) | 8 | 12 | 8 | 10 | 5 |

TABLE 1-continued

| | Examples | | | | |
|---|---|---|---|---|---|
| | 1 | 2 | 3 | 4 | CE |
| Discharge current (A) | 20 | 80 | 20 | 3 | 100 |

CE = Comparative Example

EXAMPLES 5 TO 9

Metal back-attached phosphor screens were formed according to the combinations shown in Table 2 in the same way as in Example 1 to complete color FEDs. Then, the obtained metal back-attached phosphor screens were measured for a reflectance (phosphor layer side), and the FED brightness and withstand voltage characteristics and discharge current were also measured. The measured results are shown in Table 2.

TABLE 2

| | Examples | | | | |
|---|---|---|---|---|---|
| | 5 | 6 | 7 | 8 | 9 |
| [Metal back structure] | | | | | |
| Phosphor layer side | A1 (60 nm) | A1 (60 nm) | $Al_2O_x$ (60 nm) | $In_2O_x$ (60 nm) | Single layer |
| Intermediate | — | $SiO_2$(20 nm) | — | — | $Al_2O_x$ (80 nm) |
| Rear panel side | $In_2O_x$ (20 nm) | $In_2O_x$ (20 nm) | $SiO_2$ (20 nm) | $SiO_2$ (20 nm) | |
| [Evaluation of semi-finished goods] | | | | | |
| Reflectance: | | | | | |
| before baking | 90 | 100 | 70 | 60 | 60 |
| after baking | 80 | 100 | 70 | 60 | 40 |
| [Evaluation of FED] | | | | | |
| Relative brightness(%) | 80 | 100 | 70 | 60 | 40 |
| Max. withstand voltage(kV) | 8 | 8 | 12 | 12 | 8 |
| Discharge current (A) | 20 | 20 | 3 | 3 | 10 |

It is seen from Table 1 and Table 2 that the metal back-attached phosphor screens obtained in Examples 1 to 9 have a high electric resistivity and improved withstand voltage characteristic and the reflectance prevented from lowering as compared with those of Comparative Example.

In the above-described examples, the metal back layers were formed by the transfer method, but the same effects could be obtained even when a conventional direct vapor deposition method which was a so-called lacquer method was used.

INDUSTRIAL APPLICABILITY

As described above, the peak value of discharge current is suppressed according to the present invention, so that the electron emission element or the phosphor screen of the metal back-attached phosphor screen can be prevented from being destructed or deteriorated. Therefore, the image display unit having such a phosphor screen is improved in its withstand voltage characteristic substantially and high quality display with high brightness without suffering from degradation of brightness can be realized.

What is claimed is:

1. A metal back-attached phosphor screen, comprising:

a phosphor layer formed on the inner surface of a face plate; and a metal back layer formed on the phosphor layer, wherein the metal back layer has a reflectance layer which has a light reflectance and a resistance layer which has electric resistivity, the reflectance layer being formed on the phosphor layer side and the resistance layer being formed on the top layer of the reflectance layer, and the metal back layer has a baking resistant layer comprised of Si-oxide between the reflectance layer and the resistance layer.

2. The metal back-attached phosphor screen according to claim 1, wherein the reflectance layer is comprised of at least one metal selected from the group consisting of Al, In, Sn and Bi.

3. The metal back-attached phosphor screen according to claim 1, wherein the resistance layer is comprised of oxide or nitride of at least one element selected from the groups consisting of Al, In, Sn, Bi and Si.

4. The metal back-attached phosphor screen according to claim 1, wherein the reflectance layer is comprised of at least one metal selected from the group consisting of Al, In, Sn and Bi; and the resistance layer is comprised of oxide or nitride of at least one element selected from the groups consisting of Al, In, Sn, Bi and Si.

5. The metal back-attached phosphor screen according to claim 1, wherein the metal back layer comprises an oxide of at least one metal selected from the group consisting of In, Sn and Bi.

6. A transfer film for forming a metal back, comprising:

a base film;

a parting agent layer which is formed on the base film;

a resistance layer which is formed over the parting agent layer and has electric resistivity;

a reflectance layer which is formed on the resistance layer and has a light reflectance;

an adhesive agent layer which is formed on the reflectance layer; and a Si-oxide layer which is formed between the resistance layer and the reflectance layer.

7. The transfer film for forming a metal back according to claim 6, wherein the resistance layer is comprised of oxide or nitride of at least one element selected from the group consisting of Al, In, Sn, Bi and Si.

8. The transfer film for forming a metal back according to claim 6, wherein the high-reflectance layer is comprised of at least one type of metal selected from Al, In, Sn and Bi.

9. The transfer film for forming a metal back according to claim 6, further comprising a protective film which is formed on the parting agent layer.

* * * * *